US006250486B1

(12) United States Patent
Enoki

(10) Patent No.: US 6,250,486 B1
(45) Date of Patent: Jun. 26, 2001

(54) INTEGRATED BALANCED WIRE ROPE REEVING SYSTEM FOR CARGO CONTAINER HANDLING CRANES

(76) Inventor: Masamitsu Enoki, 10 De Sabla Rd., #1105, San Mateo, CA (US) 94402

( * ) Notice: Subject to any disclaimer, the term of this patent is extended or adjusted under 35 U.S.C. 154(b) by 0 days.

(21) Appl. No.: 09/395,243

(22) Filed: Sep. 13, 1999

(51) Int. Cl.[7] ..... B66C 11/02

(52) U.S. Cl. ..... 212/322; 212/323; 212/87; 212/89; 212/270

(58) Field of Search ..... 212/322, 289, 212/270, 323, 87–93

(56) References Cited

U.S. PATENT DOCUMENTS 1,817,264 * 9/1931 Nickerson ..... 212/91
3,207,329 * 9/1965 Bevard ..... 212/332
3,311,243 * 3/1967 Bachmann ..... 212/87
3,572,515 * 3/1971 Hahn ..... 212/89
4,262,811 * 4/1981 Montague ..... 212/87
4,456,131 * 6/1984 Kuehn ..... 212/92
5,107,997 * 4/1992 Worsley ..... 212/289

FOREIGN PATENT DOCUMENTS

98/06657 * 2/1998 (WO) ..... 212/322

* cited by examiner

*Primary Examiner*—Thomas J. Brahan
(74) *Attorney, Agent, or Firm*—Bruce & McCoy; Ernest H. McCoy

(57) ABSTRACT

An Integrated Balanced Wire Rope Reeving System for Cargo Container Handling Cranes wherein the same ropes perform both load hoist and trolley traversing operations.

4 Claims, 8 Drawing Sheets

INTEGRATED BALANCED WIRE ROPE REEVING SYSTEM FOR CARGO CONTAINER HANDLING CRANES

BACKGROUND OF THE INVENTION

1. Field of the Invention

The present invention relates to cargo container handling gantry cranes and, more particularly, it relates to an improvement in the wire rope reeving for the main cargo container handling trolley of such cranes. Specifically, it relates to an integrated wire rope reeving system for gantry cranes in which the same ropes perform both load hoist and trolley traversing operations.

2. Description of the Prior Art

Cargo container handling gantry cranes are arranged in the operating configuration to extend over a longitudinal expanse to transfer cargo containers horizontally from one deposition area to another. The heaviest of such gantry cranes are usually located in railroad yards and dockside in shipping ports around the world. Dockside cranes generally have either a horizontal sliding boom or a cantilever boom, the latter of which can usually be raised by rotating it around its inboard end. An example of this type of crane is disclosed in U.S. Pat. No. 5,765,981 developed by the assignee of the present invention. Long span yard cranes are typically supported by vertical structures located inboard from the ends of the crane gantry on rail- mounted wheels. The present invention can be utilized on any of these basic types of crane designs.

Reference is made to FIG. 1 of the drawings for a representation of the '981 type of crane having a cantilevered rotatable boom 11 for which the present invention can be utilized. The crane superstructure 13 is supported on crane truck wheels 15 which are mounted on dock rails which run parallel to the edge of the harbor dock. The superstructure supports a horizontal gantry 17 disposed generally mid-height thereon at an elevated location above the cargo container pickup and deposition areas 19. The gantry is supported from below by the main legs of the superstructure. In the cantilevered rotatable boom design, sheaves are disposed at the pinnacle 21 of the superstructure of the crane to guide wire rope reeving 23 which is used to rotate the outboard or cantilevered end of the boom to the upright raised stowed position. The outboard end or end and middle of the boom are also supported from the pinnacle by mechanical links 25 when the boom is lowered to level and the wire rope reeving 23 is slack. The load supporting links for the retractable gantry are collapsible. The wire rope reeving which raises the boom takes the load off the links which collapse when the cantilevered boom is rotated to its stowed position about its hinge point 27 at its inboard end proximate the superstructure.

While, in most typical dockside applications, the gantry of a cargo container handling crane is a slidable or raisable cantilever boom extending from a crane superstructure, other types of large gantry yard cranes supported at both ends are located in large cargo container storage or transfer areas. All of these cranes are similar to the '981 gantry type crane in that they employ a movable trolley 29, usually with a suspended operator's cab 31, which shuttles along the gantry 17 and boom 11 suspending a cargo container lifting spreader 33. The spreader can be raised or lowered from the crane gantry by the operator and engages the cargo containers 35 which are on the dock or shipboard to permit them to be lifted by the trolley for transport along the gantry to the deposition area 19 in a cargo container transport ship. The trolley is reciprocated along the gantry by a continuous wire rope system which is driven by wire rope drums located in the machinery house 37.

The cargo container lift trolley 29 mounted on rails on the crane gantry sections 11, 17, 41 can traverse from one end of the gantry to the other. The trolley suspends the cargo container lifting spreader 33 from fleet-through wire rope reeving by means of a detachable headblock which carries the wire rope suspension sheaves. Different length spreaders can be secured to the headblock to accommodate correspondingly different size containers.

There are essentially three types of wire rope reeving utilized in the prior art relating to the area of the present invention. They are each disclosed in the accompanying drawings which illustrate the apparatus and method by which the wire rope reeving for the main cargo transport trolley of a shoreside cargo container handling crane is employed. The wire rope reeving causes the traversing of the trolley on the gantry and hoisting and lowering of the cargo container lifting spreader.

Reference is made to FIGS. 2 and 3 for an illustration of the first type of basic wire rope reeving. For present purposes, it will be called a rope trolley container handling crane. There are two independent systems in this type of crane, and they are shown independently in the drawings for clarity. FIG. 2 shows the main trolley traversing drive of these gantry cranes. In the normal configuration of wire rope reeving, a pair of continuous traversing or drive wire ropes 43, driven by one or a pair of trolley drive drums 45, are secured to opposite ends of the cargo transport trolley 29. The term "continuous" generally means the wire rope is a continuous loop. Portions of the rope are either towing or slack depending on the direction of movement of the trolley, and the rope is always active and continuously in motion when the trolley moves.

For the rope trolley crane of FIG. 2, the drive drums 45 for the two pairs of main trolley drive ropes 43 are usually located somewhere mid-span on the gantry 17 in a machinery house 37 (FIG. 1). The pairs of drive ropes are oppositely wound and extend from the drums to reversing sheaves 47 disposed at opposite ends of the gantry through hydraulic rope tensioners 49. The pairs of ropes reverse direction and extend from the reversing sheaves to opposite ends of the cargo container transport trolley 29 movably located anywhere along the gantry. Operation of the drive drums moves the trolley in one direction along the gantry while reverse rotation of the drive drums reverses the tension and slack forces in the drive ropes and the movement of the trolley.

Reference is made to FIG. 3. In addition to the trolley drive ropes in a rope trolley crane, a separate system of hoist or lift ropes 51 for the lifting spreader 33 are integrated into the wire rope reeving system. They are very similar in orientation, operation, and location to the trolley drive ropes in the sense that they are also driven by drive drums 53 and run through reversing sheaves 47 at one end of the crane gantry 17. They differ, however, in that the two pairs of hoist ropes are not secured to the main trolley 29 but are reeved through fleet-through sheaves 55 mounted thereon whereby they travel downward to the lifting spreader and back up to the trolley and are dead-ended 57 at the opposite end of the gantry from the reversing sheaves. The hoist ropes operate independent of the trolley drive ropes and can be static or moving as the trolley moves along the gantry depending on whether the lifting spreader for the containers is being lifted or lowered while the trolley moves.

A second type of wire rope reeving for a crane will be called a machine trolley container crane, and it is shown in FIG. 4. The hoisting machinery 59 and the trolley traversing machinery 61 are both mounted on the trolley 29. The wire ropes 53 from the drums 63 of the hoist machinery mounted on the trolley go down to reversing sheaves on the lifting spreader headblock 33 and then go back up to the trolley and are dead-ended 65 to it. The ropes may be multiply-reeved between the headblock and the trolley sheaves to obtain a greater mechanical advantage. The trolley traversing machinery drives the trolley wheels 67 to move the trolley along the rails on the girder or boom of the gantry crane.

A third type of wire rope reeving will be called a semi-rope trolley container crane, and it is shown in FIG. 5. It is a combination of the first two types. The load hoist machinery is located in the machinery house on the gantry 17 and the wire ropes 53 are reeved the same as FIG. 3. The gantry traversing machinery 61 is mounted on the trolley 29 the same as the machine trolley type container crane of FIG. 4.

The three types of prior art cranes have the following disadvantages. With respect to the machine trolley-type crane, because the hoisting machinery and the trolley traversing machinery are mounted on the trolley, the trolley becomes extremely heavy and the crane girder structure and gantry required to support the trolley must necessarily be made stronger and heavier. In addition, as the machine trolley is driven by the wheels interconnected to the trolley traversing machinery, the wheels sometimes slip in foul conditions, such as the beginning of rainfall or when the rails have early morning frost.

For the lifted load anti-sway capability of the machine trolley-type crane, an electrical anti-sway control is available. However, the effect of sway control on a machine trolley crane is to jerk the heavy trolley back and forth to stop the load sway. This is uncomfortable for the crane operator, it is detrimental to the crane structure, and it requires large power inputs to effect the sway control.

For the rope trolley crane, the trolley carries only sheaves and it does not have either hoisting machinery or trolley traversing machinery mounted on it. Therefore, the trolley is light and the crane structure can be built correspondingly lightweight. Also, as the trolley is towed by the trolley ropes, there is no wheel slip. However, as the long length of the wire ropes for the hoist machinery and the trolley traversing machinery are reeved from the machinery house to both of the girder ends and to the trolley, the wire ropes experience considerable wear and require higher maintenance costs.

For the lifted load anti-sway capability of a rope trolley crane, a hydraulic-type sway dampening device is provided at the girder end sheaves or an electrical anti-sway control is available. The hydraulic-type sway dampening device is heavy and expensive, while the electrical anti-sway device has similar problems for the operator's comfort as with the machine trolley crane.

For the semi-rope trolley crane, the crane weight is between the other two types of cranes. The trolley traversing ropes are eliminated, but the trolley is driven by the wheels connected to the trolley traversing machinery, and the wheels are subject to slippage.

For the lifted load anti-sway capability of the semi-rope trolley crane, the conditions are nearly the same as that for the machine trolley crane.

The present invention provides an improvement in crane design which reduces the effects of these disadvantages in the prior types of crane.

SUMMARY OF THE INVENTION

The present invention is an integrated balanced wire rope reeving system for a cargo container handling crane having a cargo transport trolley mounted for reciprocation along a horizontal gantry thereof. The system is comprised of a first pair of wire ropes driven by a first drive drum and extending around reversing sheaves mounted at a first end of the gantry. The wire ropes are then directed outboard to the trolley and then directed around a sheave mounted on the trolley, downward to a lifting spreader headblock suspended in part by the first pair of wire ropes below the trolley, and then directed around a sheave mounted thereon and upward to the trolley and there dead-ended. A second pair of wire ropes is driven by a second drive drum extending around reversing sheaves mounted at the other end of the gantry, then directed inboard to the trolley, then directed around a sheave mounted on the trolley, then downward to the lifting spreader headblock, and then directed around a sheave mounted thereon and upward to the trolley and there dead-ended to in part suspend the lifting spreader headblock. Drive motors are provided for the first and second drive drums and brakes are provided for the drive drums and the trolleys spring loaded locked. A programmable logic controller controls operation of the motors and brakes to lift and lower a load suspended from the trolley and to unlock the brakes move the trolley along the gantry. A mechanical control means provides input to the programmable logic controller by a crane operator, and means is provided for unlocking the brakes which is controlled by the mechnical control means through the programmable logic controller.

OBJECTS OF THE INVENTION

It is therefore an important object of the present invention to provide an improved wire rope reeving system for gantry cranes which reduces the weight of the crane load and structure.

It is another object of the present invention to provide a simplified wire rope reeving system which is less costly to manufacture, simpler to install, requires fewer wire ropes, and is easier to maintain.

It is a further object of the present invention to provide an improved wire rope reeving system which is integrated whereby the same ropes perform both the load hoist and trolley traversing functions.

It is yet another object of the present invention to provide an improved wire rope reeving system in which the wheel slip is eliminated.

It is still a further object of the present invention to provide an improved wire rope reeving system to obtain lifted load sway dampening without the requirement for additional equipment.

And it is yet another object of the present invention to provide an improved wire rope reeving system in which the load hoist and trolley traverse functions are controlled simply by joy sticks.

Other objects and advantages of the present invention will become apparent when the apparatus and method of the present invention are considered in conjunction with the accompanying drawings.

DESCRIPTION OF THE PREFERRED EMBODIMENT

Figure 1:
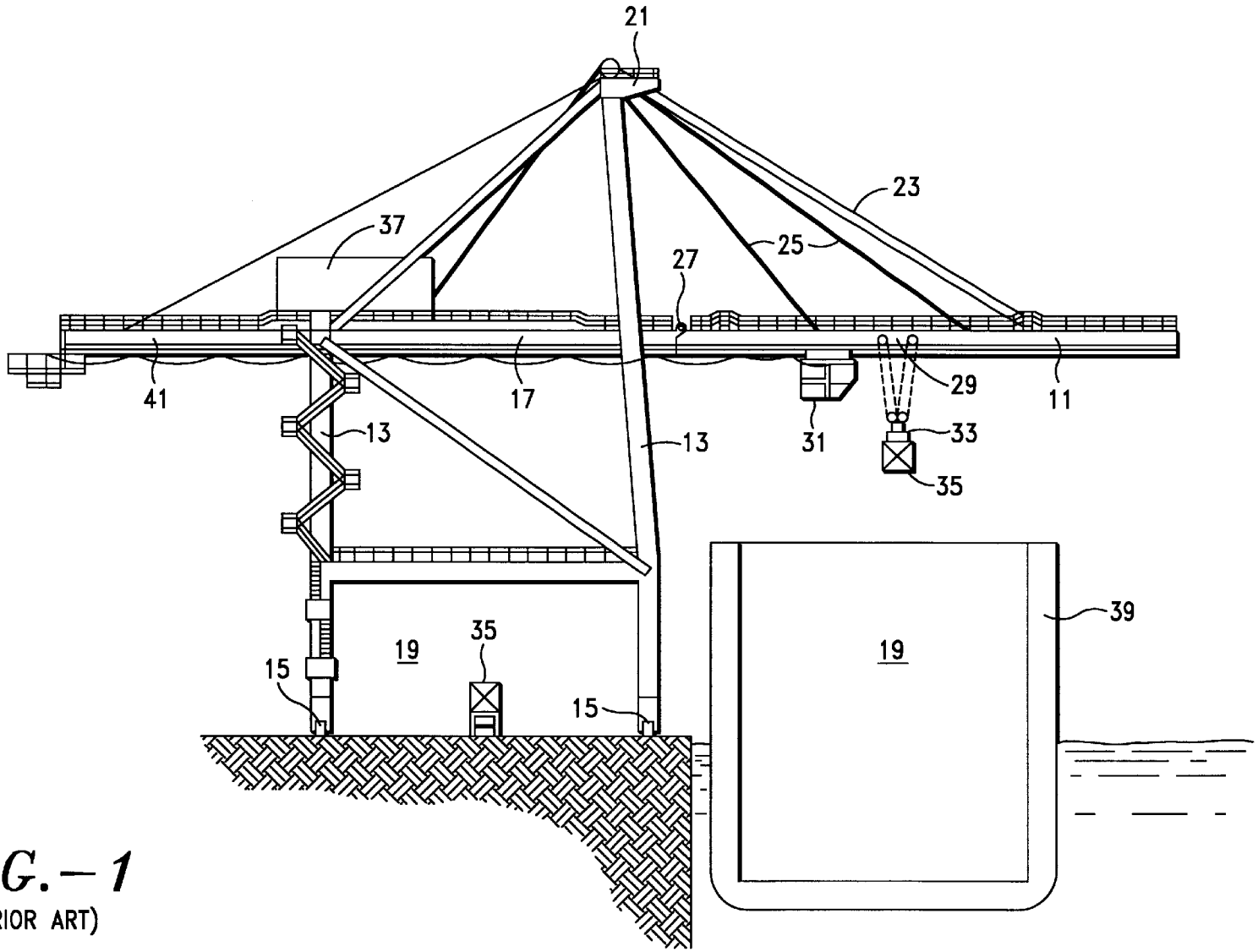
FIG.—1 (PRIOR ART)
FIG. 1 is a side elevation of a typical shoreside gantry crane having a cantilevered raisable boom which can utilize the improved apparatus of the present invention.
Figure 2:
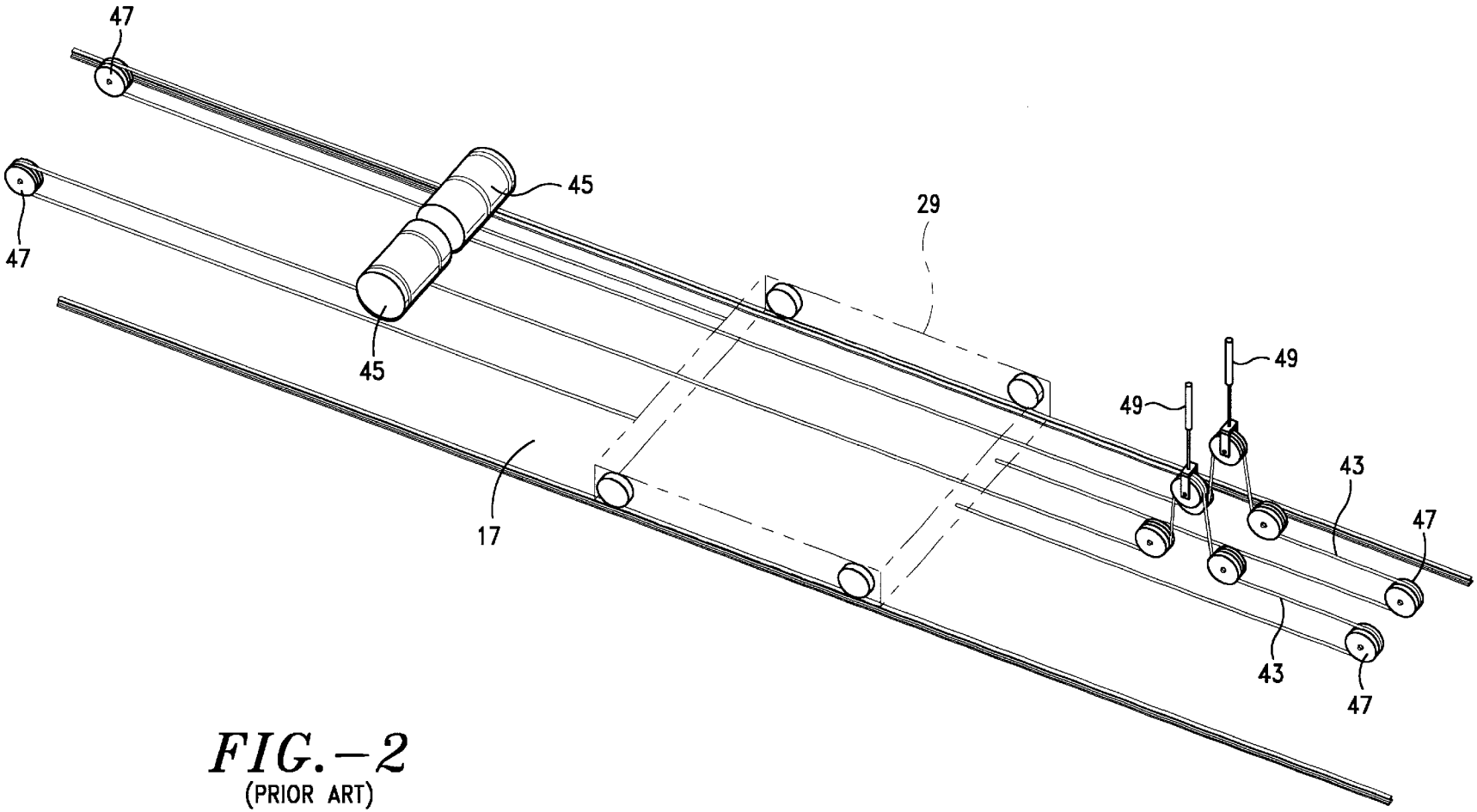
FIG.—2 (PRIOR ART)
FIG. 2 is a perspective view of the basic wire rope reeving diagram of the trolley traversing or drive wire ropes for a rope trolley container crane of the prior art.
Figure 3:
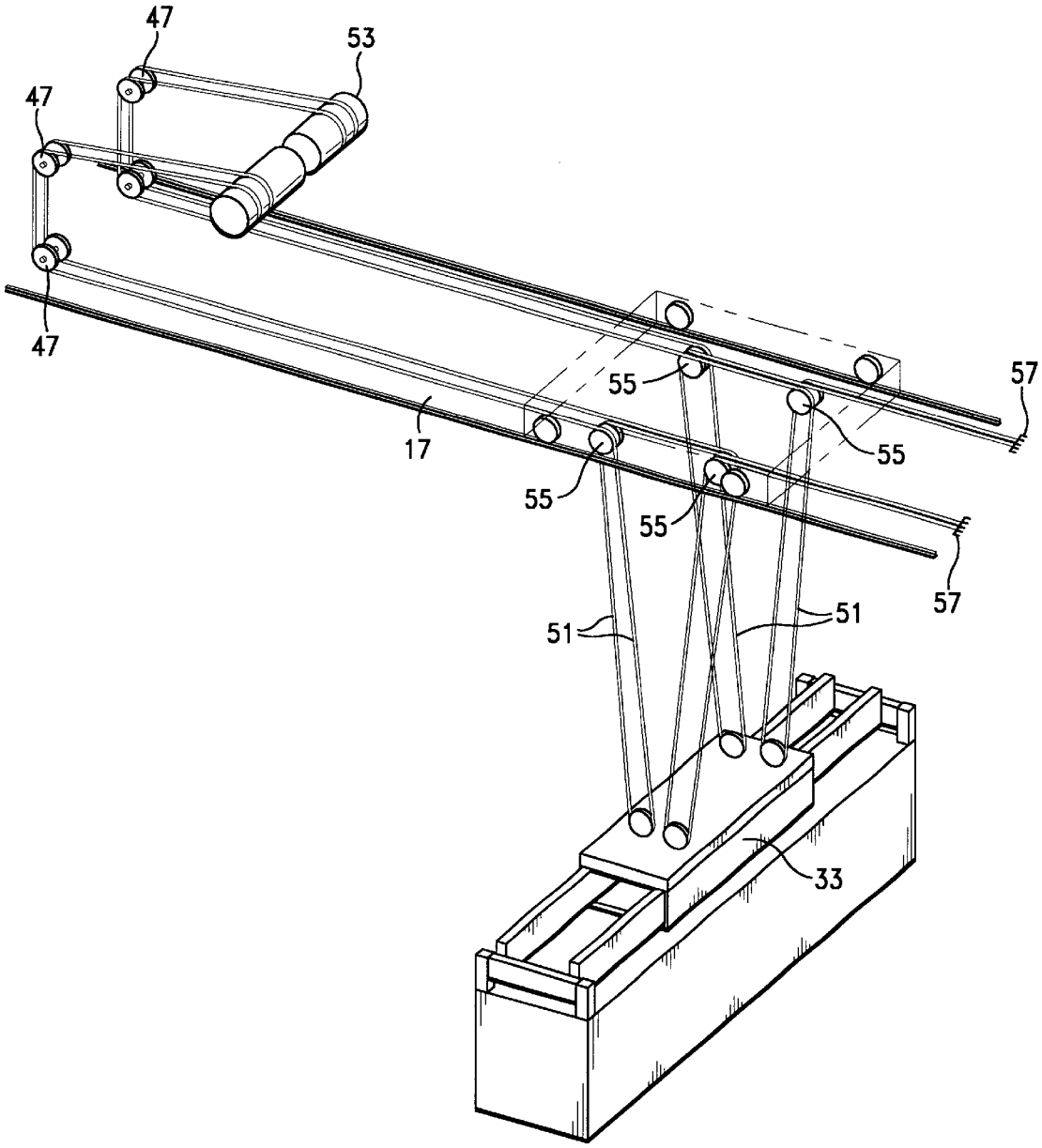
FIG.–3 (PRIOR ART)
FIG. 3 is a perspective view of the basic wire rope reeving diagram of the hoist wire ropes for a rope trolley container crane of the prior art.
Figure 4:
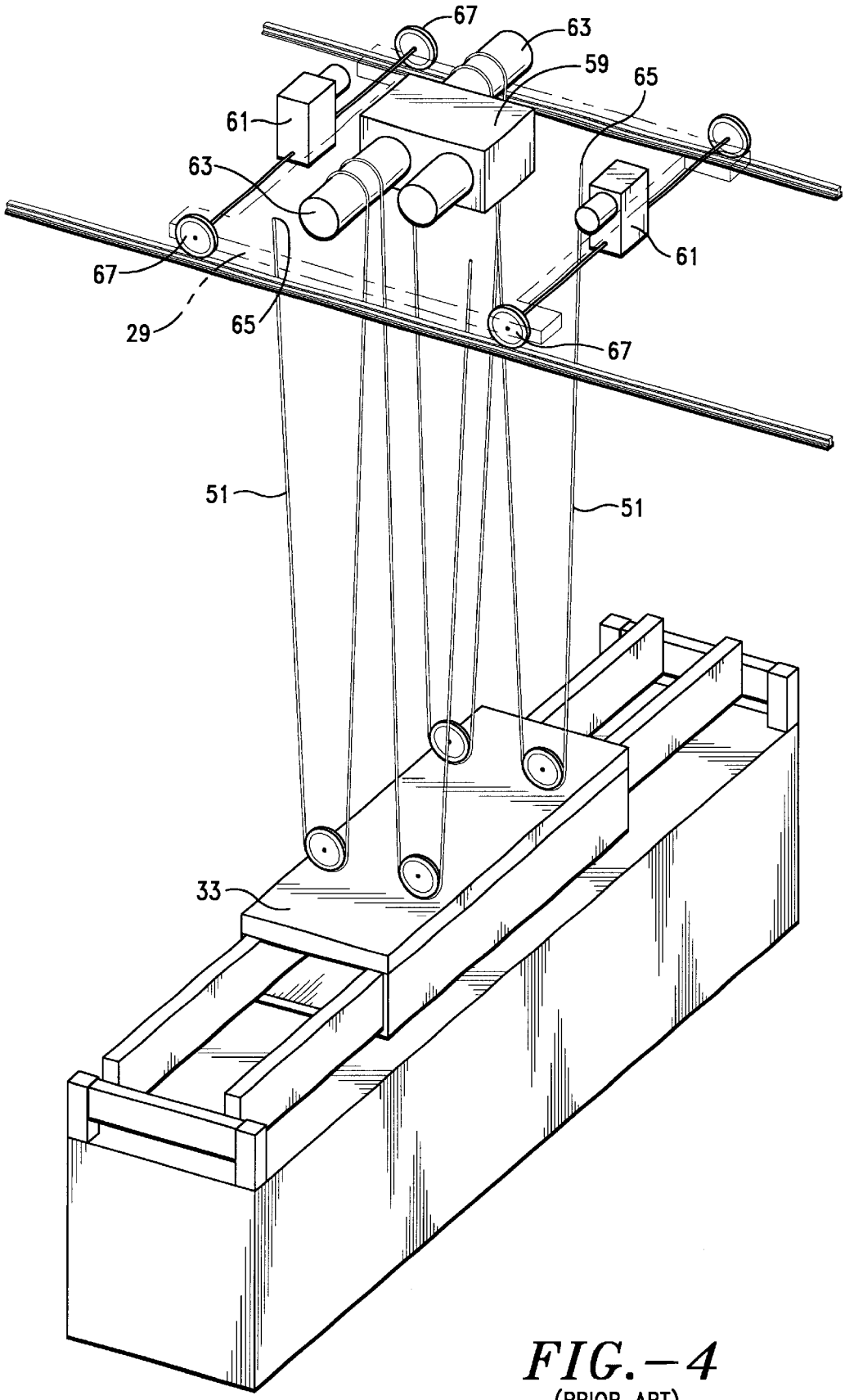
FIG.—4 (PRIOR ART)
FIG. 4 is a perspective view of a basic wire rope reeving diagram for a machine trolley container crane of the prior art.
Figure 5:
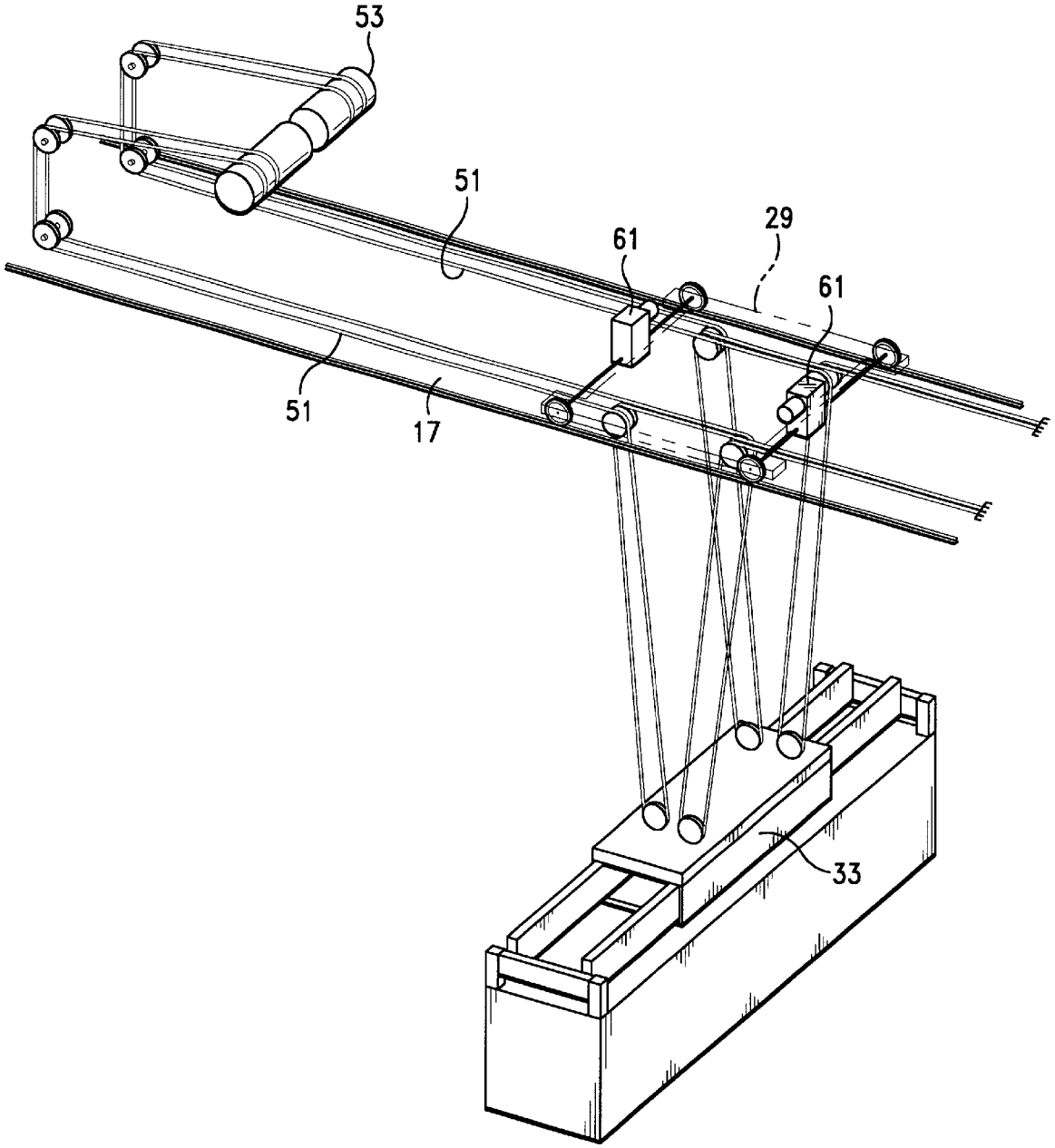
FIG.–5 (PRIOR ART)
FIG. 5 is a perspective view of the basic wire rope reeving diagram for a semi-rope trolley container crane of the prior art.
Figure 6:
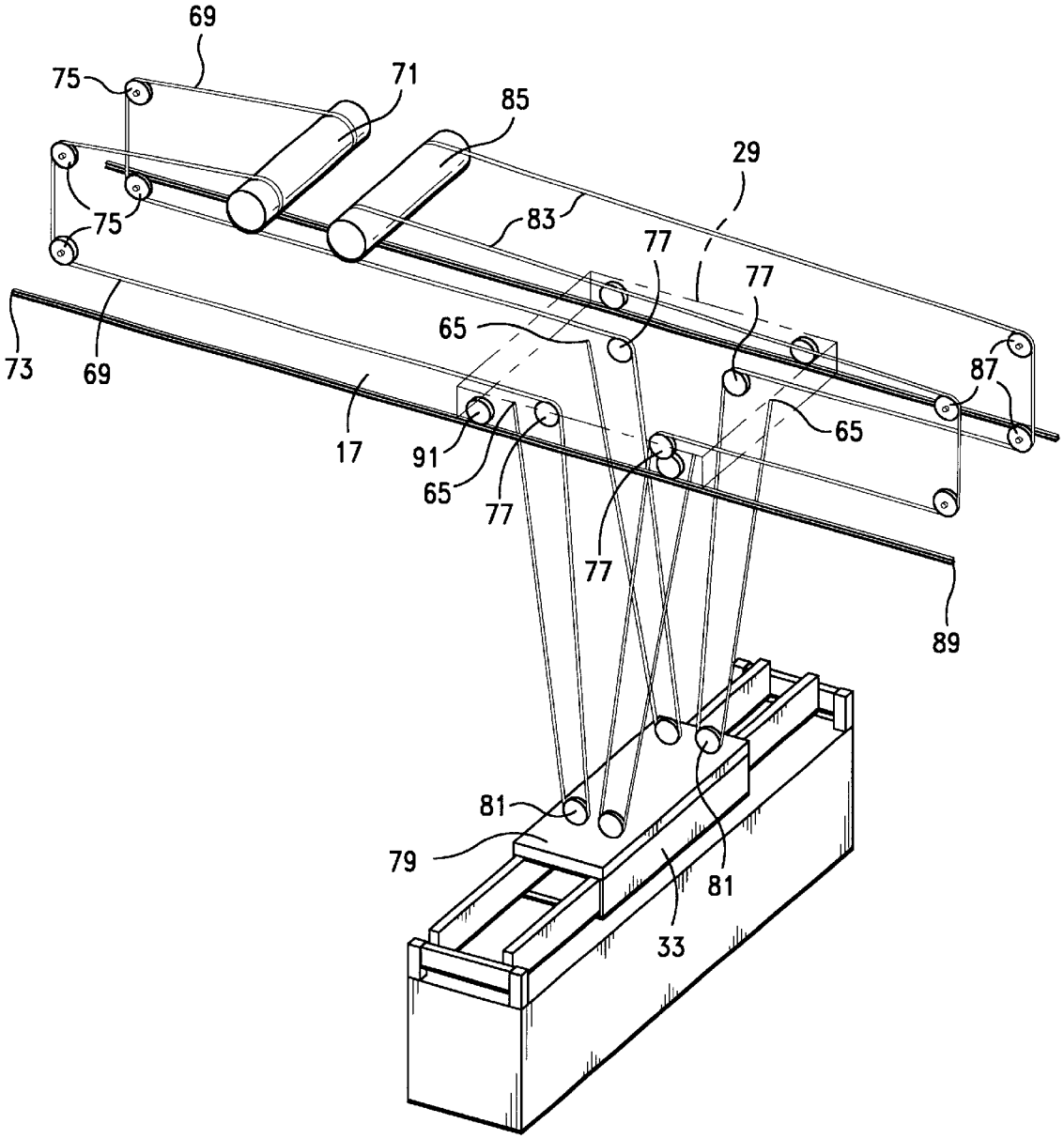
FIG. 6 is a perspective view of the wire rope reeving diagram of the integrated balanced wire rope container crane of the present invention.

Reference is made to FIG. 6 in the drawings for a description of the preferred embodiment of the present invention wherein like reference numbers represent like elements on corresponding views.

The invention is a wire rope reeving system for cargo container handling cranes having a cargo transport trolley 29 mounted for reciprocation along a horizontal gantry 17 thereof and is called a "balanced rope trolley crane." The system is comprised of an integrated wire rope trolley drive and load hoist system which is electronically and manually controlled.

A first pair of wire ropes 69 are driven by a first wire rope drive drum 71 located in the machinery house mounted at a first end 73 of the gantry 17. The wire ropes from the drum extend around reversing sheaves 75 mounted at a first end 73 of the gantry. The ropes are then directed outboard to the trolley 29 located anywhere along the gantry. The ropes are then directed around sheaves 77 mounted on the trolley and downward to a headblock 79 which is suspended in part by the first pair of wire ropes below the trolley. The headblock engages a cargo container lifting spreader 33 which picks up cargo containers and can be disengaged therefrom to change sizes of spreaders. The downward directed wire ropes from the trolley are directed around the sheaves 81 mounted in the headblock and are then directed upward to the trolley, and there they are dead-ended 65 at the trolley. The ropes may be multiply-reeved between the headblock and the trolley shaves to obtain a greater mechanical advantage.

A second pair of wire ropes 83 driven by a second wire rope drive drum 85 extend around reversing sheaves 87 mounted at the other end 89 of the gantry and are then directed inboard to the trolley 29 and around sheaves 77 mounted thereon. As with the first pair of wire ropes, the second pair of wire ropes are directed downward from the trolley to the headblock 79 and around sheaves 81 mounted therein and upward to the trolley and there dead-ended 65. The second pair of wire ropes also in part suspend the lifting spreader headblock the same as the first pair of wire ropes.

Independent drive motors are provided for the first and second drive drums 71, 85, and brakes can be integrated into the drive motors and the trolley wheels 91. When the headblock, the lifting spreader, and the load are raised or lowered, the two drive drums operate simultaneously producing the same rope speed. When the trolley is moved along the gantry, one wire rope drum unwinds while the other reels in at the same speed. When simultaneous operation of the hoist and trolley traversing is required, a combination of the above operations occurs.

Figure 7:
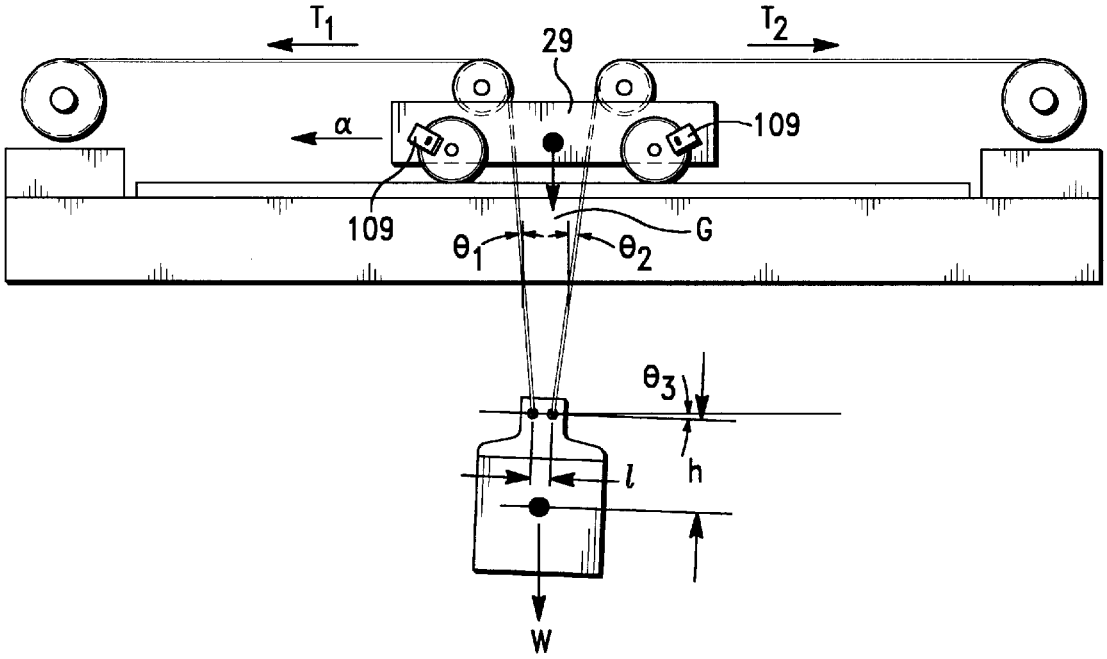
FIG. 7 shows the balance diagram of FIG. 6.

Reference is made to FIG. 7 which shows static balance equation parameters during trolley acceleration in the model simplified from the crane of FIG. 6: trolley acceleration is $\alpha$, wire rope tension are $T_1$, $T_2$, sheave distance on the trolley is L, the sheave radius is r, height from lifting block rope clamp to the trolley sheave is H, rope angles are $\theta_1$, $\theta$2, rope clamp distance of lifting block is l, height of center of gravity of lifting block and load from the rope clamp is h, inclination angle of lifting block and load is $\theta_3$, trolley weight is G, and weight of lifting block and load is W.

The static balance equation in the total system is:

$$T_1(1-\eta^*\sin\theta_1)-T_2(1-1/\eta^*\sin\theta_2)=\alpha/g^*G+k(G+W) \quad (1)$$

$$\eta^*T_1{}^*\cos\theta_1+T_2/\eta^*\cos\theta_2=W \quad (2)$$

$$\eta^*T_1\sin\theta_1=T_2/\eta^*\sin\theta_2+\alpha/g^*W \quad (3)$$

$$L\approx 2^*r+1+H(\sin\theta_1+\sin\theta_2) \quad (4)$$

The moment balance on the right side rope clamp point of lifting block:

$$W(0.5^*1^*\cos\theta_3-h^*\sin\theta_3)\approx\alpha/g^*W(0.5^*1^*\sin\theta_3+h^*\cos\theta_3)+T_2/\eta^*1^*\cos(\theta_2-\theta_3) \quad (5)$$

where, k is trolley running resistance including wind;

$\eta$ is sheave mechanical efficiency; and g is gravitational constant.

Unknown factors are $T_1$, $T_2$, $\theta_1$, $\theta_2$ and $\theta_3$, and there are five equations. Therefore, unknown factors can be solved. For practical use, the trolley acceleration $\alpha$ must be decided under the condition of $T_2>0$. Also, $\theta_3$ should be small. For the load sway, the load will swing around before balancing.

Figure 8:
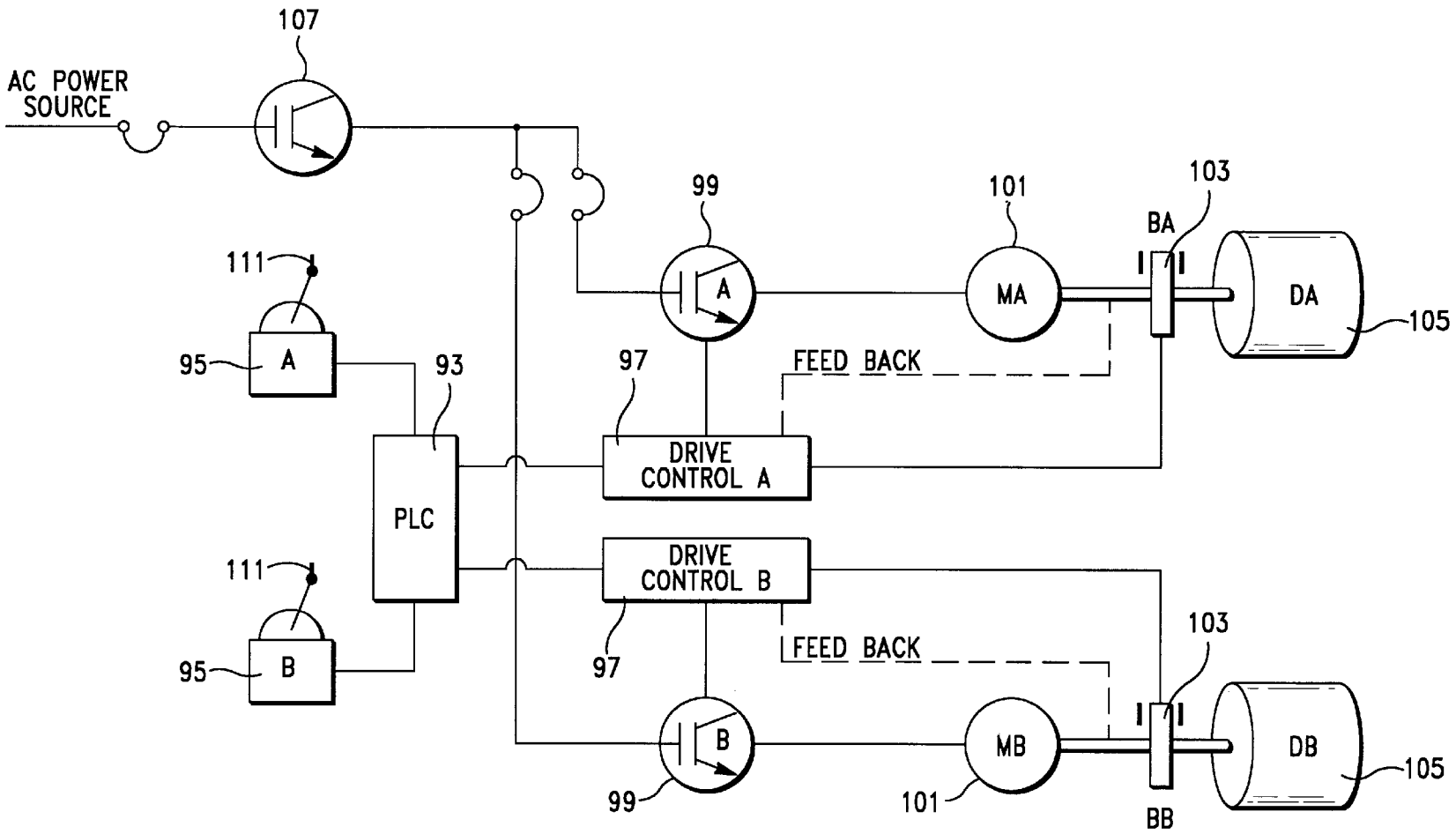
FIG. 8 is a diagram of the control system.

FIG. 8 is a diagram of the control system. A programmable logic controller (PLC) 93 is provided for controlling the operation of the DA & DB drive motors 101 which are provided to lift and lower a load simultaneously with movement of the trolley as well as with the trolley at rest.

A mechanical control means is provided for providing input to the PLC 93 by a crane operator. For this purpose, separate A & B joysticks 95 are provided for hoist and for trolley traverse. Forward and back on the hoist joystick lowers and raises the load, and forward and back on the trolley traverse joystick moves the trolley accordingly. The speeds of operation are proportional to the displacement of the joysticks from neutral. The signals from the joysticks are integrated in the PLC to run the A & B drive controls 97. They control the MA & MB inverters 99 to operate BA & BB drive motors 101 and A & B motor brakes 103 which drive and stop the A & B wire rope drive drums 105.

DC power is supplied to the inverters 99 through the AC power converter 107. The PLC 93 creates reference signals for the A & B drive controls 97 by combining the operation signals from the A & B joysticks 95 for load hoist and trolley traverse. The A & B drive controls 97 control the A & B inverters 99 which convert the DC back to AC and provide power for the MA & MB motors 101 which drive the DA & DB drums 105. Feedback from the drive motors to the A & B drive controls is motor speed.

The BA & BB motor brakes 103 release or open when the motors are energized. Otherwise, the motor brakes 109 are locked or closed. The wheel brakes on the trolley 29 release or open when the joystick for trolley traverse is actuated. Otherwise, the wheel brakes are locked or closed. The wheel and motor brakes are spring loaded closed and electric solenoid or hydraulic pressure opened.

Each joystick 95 has a thumb switch 111. When the joysticks have been displaced from neutral, pressing the thumbswitch causes the motors to drop to dead (slow) speed for accurate positioning of the height of the load or of the trolley movement along the gantry. When an unbalanced load results between the two pairs of wire ropes during operation, it is easy to balance the loads in the ropes by applying the respective thumb switch.

When the thumb switch of the hoist joystick is pushed when the joystick is at the neutral position, the hoisting motors are energized to create the same torque, and the wheel brakes close keeping the load at a standstill.

Very effective sway dampening is provided for the load sway. It results from applying the thumb switch of the trolley traverse joystick when it is at its neutral position. The wheel brakes open, the swaying load pulls on the trolley, and the trolley is moved by the swaying load. The sway energy is then absorbed by the moving resistance of the trolley. As a result, there is no additional equipment required for load sway dampening.

It is not necessary to provide exact accuracy of motor drive control because the unbalanced speed of the two motors moves the trolley. As a result, the trolley movement becomes an equalizer of the two motors. Therefore, unbalanced speed of two motors during hoisting or lowering can be compensated automatically with a little movement of the trolley by applying the trolley joystick thumb switch at neutral position to open the wheel brakes. If the trolley subsequently needs repositioning, the operator moves the joystick in that direction keeping the thumb switch pushed.

When picking up a load by the lifting spreader, the wheel brakes are locked in order to prevent the trolley from moving due to an unbalanced load. Initially, the load is lifted until the operator can move the trolley with the load in a safe condition or height.

The present invention also includes a method for operating the wire rope reeving system of a cargo container handling crane having a cargo transport trolley mounted for reciprocation along a horizontal gantry thereof. The steps of the method comprise providing first and second pairs of wire ropes reeved around reversing sheaves mounted at opposite ends of the gantry and extending inboard to the trolley and directing pairs of wire ropes downward from the trolley by sheaves mounted thereon to a headblock suspended below the trolley and around sheaves mounted thereon and back up to the trolley where they are dead ended; driving the first and second pairs of wire ropes by independent wire rope drums; providing brakes for the wire rope drums and trolley which are spring loaded locked; moving the trolley along the gantry by unlocking the brakes and taking in rope on one of the drive drums while reeling out wire rope from the other at the same speed; lifting and lowering the headblock suspended from the trolley by reeling in and reeling out wire rope by the drive drums at the same speed while the brakes are locked; and moving the trolley and lifting or lowering a load simultaneously by differential speed operation of the drive drums while the brakes are unlocked.

The method of the invention also includes dampening the sway of a suspended load by unlocking the brakes on the drums and the trolley to allow the sway energy of the load to be absorbed by the moving resistance of the trolley.

From the foregoing description of the preferred embodiment of the present invention, it can be seen that the balanced trolley crane can achieve the stated objects and advantages of the invention, and that the new and novel crane design overcomes the disadvantages earlier described in the Description of the Prior Art. It is obvious that the design of the present invention can be utilized for smaller sized cranes other than those handling cargo containers. More particularly, the anti-sway capabilities can be incorporated into other crane designs. Therefore, when reference is made to cargo containers, lifting spreaders, and lifting spreader headblocks, any type of load can be substituted therefor. Likewise, when the term "joystick" is referred to herein, any kind of control handle can be substituted therefor.

Thus, the present invention permits a lightweight and economical crane structure far lighter than for the machine trolley and semi-rope trolley cranes and also lighter than for the rope trolley cranes. However, the present invention eliminates trolley towing ropes and minimizes wire rope reeving, thereby requiring considerably less maintenance than a rope trolley crane and comparable to the machine and semi-rope trolley cranes.

The balanced trolley crane has the advantage of a rope trolley crane in that it has no wheel slip problem, unlike the machine and semi-rope trolley cranes, but with the further advantage of not requiring trolley traversing wire ropes. Most important, the lifted load anti-sway capability is built into the system and eliminates the expense and trolley jerking of an electrical anti-sway mechanism and the expense and weight of a hydraulic anti-sway mechanism.

Thus, it will be apparent from the foregoing description of the invention in its preferred form that it will fulfill all the objects and advantages attributable thereto. While it is illustrated and described in considerable detail herein, the invention is not to be limited to such details as have been set forth except as may be necessitated by the appended claims.

We claim:

1. An integrated balanced wire rope reeving system for a cargo container handling crane having a cargo transport trolley mounted for reciprocation along a horizontal gantry thereof, said system comprising a first pair of wire ropes driven by a first drive drum and extending around reversing sheaves mounted at a first end of said gantry and then directed outboard to said trolley and then directed around sheaves mounted in the corners at a first end on said trolley and downward to a headblock suspended in part by said first pair of wire ropes below said trolley and then directed around sheaves mounted thereon near the opposite edges thereof and upward to said trolley and there dead-ended, a second pair of wire ropes driven by a second drive drum extending around reversing sheaves mounted at the other end of said gantry and then directed inboard to said trolley and then directed around sheaves mounted in the corners at a second end on said trolley and downward to said headblock and then directed around sheaves mounted thereon near the opposite edges thereof and upward to said trolley and there dead-ended the same as said first pair of wire ropes to also in part suspend said headblock, drive motors for said first and second drive drums, brakes for said drive drums and said transport trolley, said brakes being spring loaded locked, a programmable logic controller controlling the operation of said motors and said brakes to lift and lower a load suspended from said trolley and to unlock said brakes and move said trolley along said gantry either simultaneously or independently, mechanical control means for providing input to said programmable logic controller by a crane operator, and means for unlocking said brakes controlled by said mechanical control means through said programmable logic controller.

2. The integrated balanced wire rope reeving system of claim 1 wherein said control means includes first and second operator control joysticks, said first joystick controlling the trolley movement functions through said programmable logic controller and said second joystick controlling the load lift and lower functions of said crane through said programmable logic controller.

3. A method for operating the wire rope reeving system of a cargo container handling crane having a cargo transport trolley mounted for reciprocation along a horizontal gantry thereof, the steps comprising providing first and second pairs of wire ropes reeved around reversing sheaves mounted at opposite ends of said gantry and extending inboard to said trolley and directed downward from said trolley by sheaves mounted thereon to a headblock suspended below said trolley and around sheaves mounted thereon and back up to said trolley where they are dead ended, driving said first and second pairs of wire ropes by independent wire rope drums, providing brakes for said wire rope drums and said trolley which are spring loaded locked, moving said trolley along said gantry by unlocking said brakes and taking in rope on one of said drive drums while reeling out wire rope from the other at the same speed, lifting and lowering said headblock suspended from said trolley by reeling in and reeling out wire rope by said drive drums at the same speed while said brakes are locked, and moving said trolley and lifting or lowering a load simultaneously by differential speed operation of said drive drums while said brakes are unlocked.

4. The method of claim 3 wherein suspended load sway is dampened by unlocking said brakes and allowing the sway energy of said load to be absorbed by the moving resistance of said trolley.

* * * * *